US011448988B2

(12) United States Patent
Saito

(10) Patent No.: US 11,448,988 B2
(45) Date of Patent: Sep. 20, 2022

(54) FIXING DEVICE AND IMAGE FORMING APPARATUS

(71) Applicant: Ricoh Company, Ltd., Tokyo (JP)

(72) Inventor: Kazuya Saito, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/241,167

(22) Filed: Apr. 27, 2021

(65) Prior Publication Data

US 2021/0364957 A1 Nov. 25, 2021

(30) Foreign Application Priority Data

May 19, 2020 (JP) ..... JP2020-087523

(51) Int. Cl.
*G03G 15/20* (2006.01)

(52) U.S. Cl.
CPC ..... *G03G 15/2053* (2013.01); *G03G 15/2064* (2013.01); *G03G 2215/2038* (2013.01)

(58) Field of Classification Search
CPC ..... G03G 15/2017; G03G 15/2053; G03G 2215/2003
See application file for complete search history.

(56) References Cited

U.S. PATENT DOCUMENTS

2009/0092423 A1* 4/2009 Shin ..... G03G 15/2064 399/329
2016/0091852 A1* 3/2016 Matsuno ..... G03G 15/2064 399/322
2016/0098003 A1 4/2016 Uchitani et al.
2016/0274514 A1 9/2016 Ishii et al.
2016/0327891 A1 11/2016 Ikebuchi et al.
2016/0378033 A1 12/2016 Ishigaya et al.
2017/0010571 A1 1/2017 Matsuda et al.
2017/0017182 A1 1/2017 Saito et al.
2017/0212457 A1 7/2017 Ishigaya et al.
2017/0248879 A1 8/2017 Ishigaya et al.
2017/0248885 A1 8/2017 Saito et al.
2017/0255149 A1 9/2017 Takagi et al.
2017/0255150 A1 9/2017 Hase et al.
(Continued)

FOREIGN PATENT DOCUMENTS

JP 2011-242686 12/2011
JP 2015-145950 8/2015
(Continued)

*Primary Examiner* — Thomas S Giampaolo, II
(74) *Attorney, Agent, or Firm* — Xsensus LLP

(57) ABSTRACT

A fixing device includes a fixing rotator that rotates and a heat source that heats the fixing rotator. A pressure rotator contacts an outer circumferential surface of the fixing rotator. A nip former is disposed opposite the pressure rotator via the fixing rotator to form a nip between the fixing rotator and the pressure rotator. A support supports the nip former and includes a metal member. The nip former includes a resin nip forming member made of resin and a metal nip forming member made of metal and interposed between the resin nip forming member and the fixing rotator. The metal nip forming member includes a contact face disposed in at least a part of a lateral end span of the nip former in a longitudinal direction of the nip former. The contact face contacts the metal member of the support.

17 Claims, 5 Drawing Sheets

(56) References Cited

U.S. PATENT DOCUMENTS

| | | | |
|---|---|---|---|
| 2017/0277091 | A1 | 9/2017 | Uchitani et al. |
| 2017/0293245 | A1 | 10/2017 | Kawata et al. |
| 2018/0046121 | A1 | 2/2018 | Kawata et al. |
| 2019/0094764 | A1 | 3/2019 | Ishigaya et al. |
| 2021/0041812 | A1 | 2/2021 | Mimbu et al. |

FOREIGN PATENT DOCUMENTS

| | | |
|---|---|---|
| JP | 2016-173559 | 9/2016 |
| JP | 2016-200802 | 12/2016 |
| JP | 2017-116961 | 6/2017 |
| JP | 2017-142541 | 8/2017 |
| JP | 2018-124563 | 8/2018 |

* cited by examiner

FIXING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-087523, filed on May 19, 2020, in the Japan Patent Office, the entire disclosure of which is hereby incorporated by reference herein.

BACKGROUND

Technical Field

Exemplary aspects of the present disclosure relate to a fixing device and an image forming apparatus.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device including a nip former that suppresses uneven temperature of a fixing rotator in an axial direction thereof when a recording medium is conveyed through a fixing nip formed between the fixing rotator and a pressure rotator. The nip former includes a metal member having an increased thermal conductivity and a supporting member that supports the metal member and is made of resin having an increased insulation.

The metal member covers an entire nip face of the nip former, that is disposed opposite the fixing nip. The metal member has an increased thermal capacity and therefore may affect a warmup time of the fixing rotator. Hence, if the metal member has an increased thickness to suppress uneven temperature of the fixing rotator caused by temperature increase of a lateral end span of the fixing rotator in the axial direction thereof when the recording medium is conveyed through the fixing nip, the warmup time of the fixing rotator may increase, generating a trade-off relation between the thickness of the metal member and the warmup time.

SUMMARY

This specification describes below an improved fixing device. In one embodiment, the fixing device includes a fixing rotator that rotates and a heat source that heats the fixing rotator. A pressure rotator contacts an outer circumferential surface of the fixing rotator. A nip former is disposed opposite the pressure rotator via the fixing rotator to form a nip between the fixing rotator and the pressure rotator. A support supports the nip former and includes a metal member. The nip former includes a resin nip forming member made of resin and a metal nip forming member made of metal and interposed between the resin nip forming member and the fixing rotator. The metal nip forming member includes a contact face disposed in at least a part of a lateral end span of the nip former in a longitudinal direction of the nip former. The contact face contacts the metal member of the support.

This specification further describes an improved fixing device. In one embodiment, the fixing device includes a fixing rotator that rotates and a heat source that heats the fixing rotator. A pressure rotator contacts an outer circumferential surface of the fixing rotator. A nip former is disposed opposite the pressure rotator via the fixing rotator to form a nip between the fixing rotator and the pressure rotator. A support supports the nip former and includes a metal member. The nip former includes a resin nip forming member made of resin, a metal nip forming member made of metal and interposed between the resin nip forming member and the fixing rotator, and a thermal conductor made of metal. The metal nip forming member includes a contact face disposed in at least a part of a lateral end span of the nip former in a longitudinal direction of the nip former. The contact face contacts the thermal conductor.

This specification further describes an improved image forming apparatus. In one embodiment, the image forming apparatus includes an image bearer that bears an image and the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
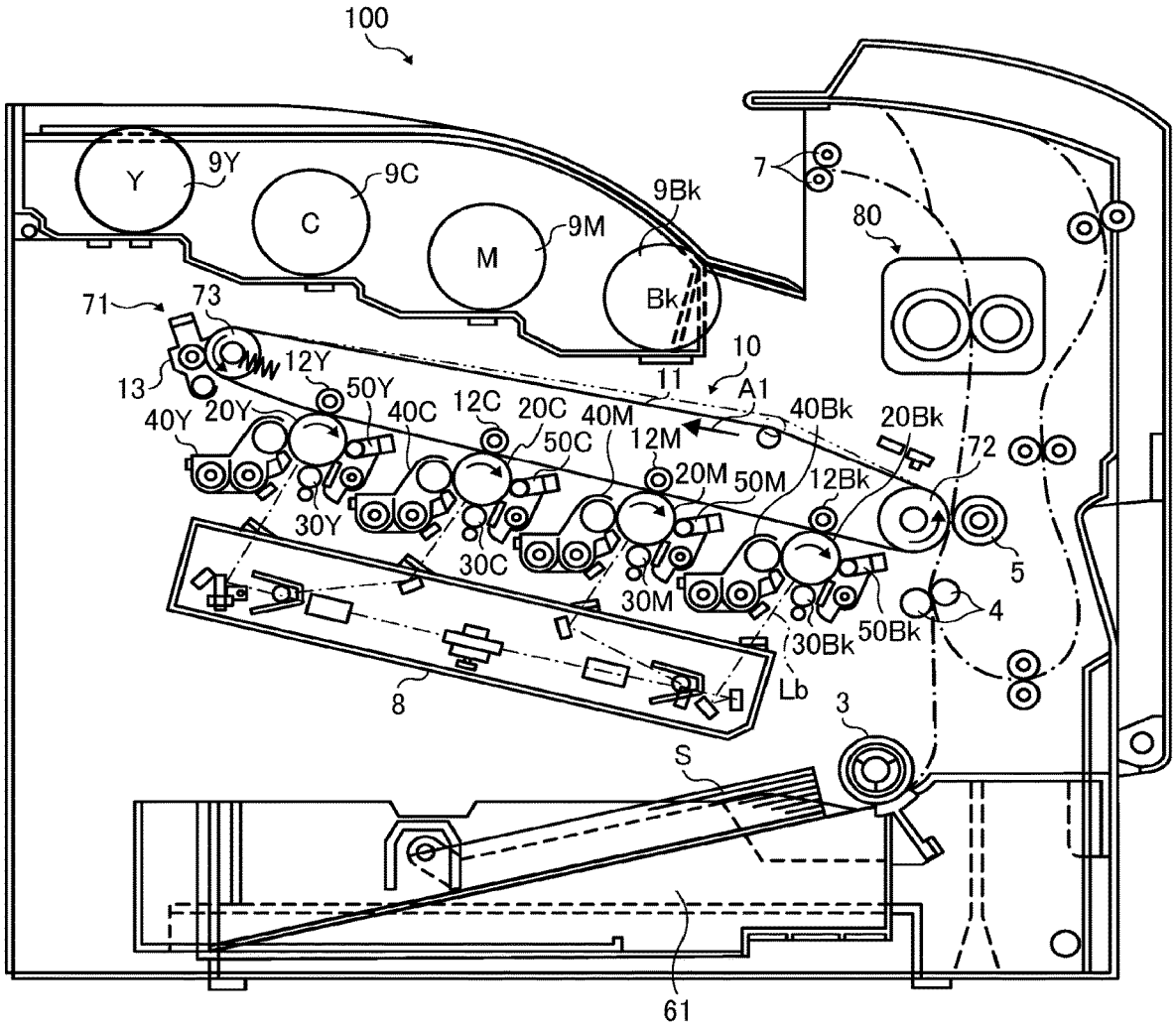
FIG. 1 is a schematic cross-sectional view of an image forming apparatus according to an embodiment of the present disclosure, illustrating an example of a construction of the image forming apparatus.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of embodiments of the present disclosure. The technology of the present disclosure is not limited to the embodiments described below and may be modified within scopes suggested by those skilled in art, such as other embodiments, addition, modification, and deletion. The technology of the present disclosure encompasses various embodiments that achieve operations and advantages of the technology of the present disclosure. In the drawings, identical reference numerals are assigned to components and equivalents that have an identical construction or an identical function and a description of those components and the equivalents is omitted.

Referring to FIG. 1, a description is provided of a construction of an image forming apparatus 100 according to an embodiment of the present disclosure.

The image forming apparatus 100 is a color printer employing a tandem system in which a plurality of image forming devices that forms images in a plurality of colors, respectively, is aligned in a rotation direction A1 of an intermediate transfer belt 11.

The image forming apparatus 100 includes photoconductive drums 20Y, 20C, 20M, and 20Bk serving as image bearers that bear images in yellow (Y), cyan (C), magenta (M), and black (Bk) as color separation components, respectively.

Yellow, cyan, magenta, and black toner images as visible images formed on the photoconductive drums 20Y, 20C, 20M, and 20Bk, respectively, are transferred onto the intermediate transfer belt 11 that rotates in the rotation direction A1 in a primary transfer process such that the visible images are superimposed on the intermediate transfer belt 11. The intermediate transfer belt 11 serves as an intermediate transferor that is disposed opposite the photoconductive drums 20Y, 20C, 20M, and 20Bk.

Thereafter, the visible images formed on the intermediate transfer belt 11 are transferred collectively onto a sheet S serving as a recording medium in a secondary transfer process.

Each of the photoconductive drums 20Y, 20C, 20M, and 20Bk is surrounded by image forming units that form the visible image as each of the photoconductive drums 20Y, 20C, 20M, and 20Bk rotates.

Taking the photoconductive drum 20Bk that forms the black toner image as an example, a description is provided of configurations of the image forming units.

The photoconductive drum 20Bk is surrounded by a charger 30Bk, a developing device 40Bk, a primary transfer roller 12Bk, and a cleaner 50Bk which form the black toner image and are arranged in a rotation direction of the photoconductive drum 20Bk. Similarly, chargers 30Y, 30C, and 30M, developing devices 40Y, 40C, and 40M, primary transfer rollers 12Y, 12C, and 12M, and cleaners 50Y, 50C, and 50M are arranged in a rotation direction of the photoconductive drums 20Y, 20C, and 20M, respectively.

After the charger 30Bk charges a surface of the photoconductive drum 20Bk, an optical writing device 8 performs optical writing on the surface of the photoconductive drum 20Bk according to image data, forming an electrostatic latent image on the surface of the photoconductive drum 20Bk.

The developing device 40Bk visualizes the electrostatic latent image into a black toner image.

While the intermediate transfer belt 11 rotates in the rotation direction A1, the primary transfer rollers 12Y, 12C, 12M, and 12Bk primarily transfer yellow, cyan, magenta, and black toner images formed on the photoconductive drums 20Y, 20C, 20M, and 20Bk, respectively, onto the intermediate transfer belt 11 such that the yellow, cyan, magenta, and black toner images are superimposed on a same position on the intermediate transfer belt 11.

The primary transfer rollers 12Y, 12C, 12M, and 12Bk disposed opposite the photoconductive drums 20Y, 20C, 20M, and 20Bk via the intermediate transfer belt 11 apply a voltage to primarily transfer the yellow, cyan, magenta, and black toner images formed on the photoconductive drums 20Y, 20C, 20M, and 20Bk at different times from the upstream photoconductive drum 20Y to the downstream photoconductive drum 20Bk in the rotation direction A1 of the intermediate transfer belt 11.

The photoconductive drums 20Y, 20C, 20M, and 20Bk are aligned in this order from the upstream photoconductive drum 20Y to the downstream photoconductive drum 20Bk in the rotation direction A1 of the intermediate transfer belt 11.

Imaging stations that form the yellow, cyan, magenta, and black toner images include the photoconductive drums 20Y, 20C, 20M, and 20Bk, respectively.

The image forming apparatus 100 includes four imaging stations that form yellow, cyan, magenta, and black toner images, respectively, and an intermediate transfer belt unit 10 disposed opposite and above the photoconductive drums 20Y, 20C, 20M, and 20Bk in FIG. 1. The intermediate transfer belt unit 10 includes the intermediate transfer belt 11 and the primary transfer rollers 12Y, 12C, 12M, and 12Bk.

The image forming apparatus 100 further includes a secondary transfer roller 5 serving as a secondary transferor that is disposed opposite the intermediate transfer belt 11 and rotates in accordance with rotation of the intermediate transfer belt 11.

The image forming apparatus 100 further includes an intermediate transfer belt cleaner 13 that is disposed opposite the intermediate transfer belt 11 and cleans a surface of the intermediate transfer belt 11.

The optical writing device 8 is disposed opposite and below the four imaging stations in FIG. 1.

The optical writing device 8 includes a semiconductor laser serving as a light source, a coupling lens, an f-θ lens, a toroidal lens, a reflection mirror, and a polygon mirror serving as a deflector.

The optical writing device 8 emits light beams Lb that correspond to yellow, cyan, magenta, and black image data onto the photoconductive drums 20Y, 20C, 20M, and 20Bk, forming electrostatic latent images on the photoconductive drums 20Y, 20C, 20M, and 20Bk, respectively.

Although FIG. 1 illustrates the light beam Lb directed to the imaging station that forms the black toner image, the light beams Lb are also directed to the imaging stations that form the yellow, cyan, and magenta toner images, respectively.

The image forming apparatus 100 further includes a sheet feeder 61, a registration roller pair 4, and a sensor. The sheet feeder 61 is disposed in a lower portion of the image forming apparatus 100 in FIG. 1. The sheet feeder 61 is a sheet feeding tray (e.g., a paper tray) that loads sheets S to be conveyed to a secondary transfer nip formed between the secondary transfer roller 5 and the intermediate transfer belt 11.

The registration roller pair 4 feeds a sheet S conveyed from the sheet feeder 61 toward the secondary transfer nip formed between the intermediate transfer belt 11 and the secondary transfer roller 5 at a predetermined time when the yellow, cyan, magenta, and black toner images formed on the intermediate transfer belt 11 by the imaging stations reach the secondary transfer nip.

The sensor detects that a leading edge of the sheet S reaches the registration roller pair 4.

The secondary transfer roller 5 secondarily transfers the yellow, cyan, magenta, and black toner images formed on the intermediate transfer belt 11 onto the sheet S, thus forming a color toner image on the sheet S. The sheet S bearing the color toner image is conveyed to a fixing device 80 that fixes the color toner image on the sheet S under heat and pressure.

A sheet ejecting roller pair 7 ejects the sheet S bearing the fixed color toner image onto a top face of an apparatus body of the image forming apparatus 100. The top face serves as a sheet ejection tray.

Toner bottles 9Y, 9C, 9M, and 9Bk are disposed below the top face of the apparatus body of the image forming apparatus 100 and replenished with yellow, cyan, magenta, and black toners, respectively.

In addition to the intermediate transfer belt 11 and the primary transfer rollers 12Y, 12C, 12M, and 12Bk, the intermediate transfer belt unit 10 includes a driving roller 72 and a driven roller 73 over which the intermediate transfer belt 11 is looped.

The driven roller 73 also serves as a tension applicator that applies tension to the intermediate transfer belt 11. Hence, a biasing member such as a spring biases the driven roller 73 against the intermediate transfer belt 11.

The intermediate transfer belt unit 10, the primary transfer rollers 12Y, 12C, 12M, and 12Bk, the secondary transfer roller 5, and the intermediate transfer belt cleaner 13 construct a transfer device 71.

The sheet feeder 61 includes a sheet feeding roller 3 that comes into contact with an upper surface of an uppermost sheet S of the sheets S placed in the sheet feeder 61. As the sheet feeding roller 3 is driven and rotated counterclockwise in FIG. 1, the sheet feeding roller 3 feeds the uppermost sheet S to the registration roller pair 4.

The intermediate transfer belt cleaner 13 installed in the transfer device 71 includes a cleaning brush and a cleaning blade that are disposed opposite and brought into contact with the intermediate transfer belt 11.

The cleaning brush and the cleaning blade of the intermediate transfer belt cleaner 13 scrape and remove a foreign substance such as residual toner from the intermediate transfer belt 11.

The intermediate transfer belt cleaner 13 further includes a discharging device that conveys the residual toner removed from the intermediate transfer belt 11 for disposal.

A detailed description is provided of a construction of the fixing device 80.

Figure 2:
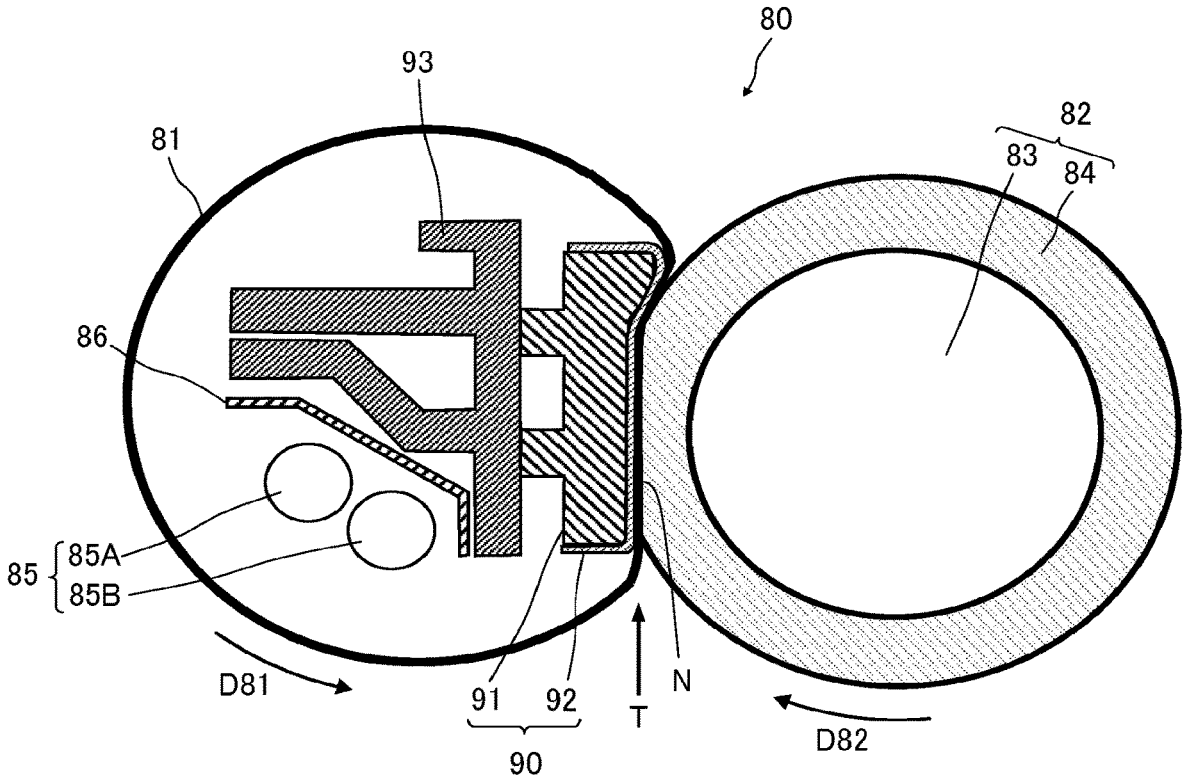
FIG. 2 is a schematic cross-sectional view of a fixing device incorporated in the image forming apparatus depicted in FIG. 1, illustrating an example of a construction of the fixing device.

FIG. 2 is a schematic cross-sectional view of the fixing device 80 according to an embodiment of the present disclosure, illustrating an example of the construction of the fixing device 80.

As illustrated in FIG. 2, the fixing device 80 includes a fixing belt 81 serving as a fixing rotator or a fixing member and a pressure roller 82 serving as a pressure rotator or a pressure member. The fixing belt 81 is an endless belt that is thin and has flexibility. The fixing belt 81 is rotatable in a rotation direction D81 and tubular or cylindrical. The pressure roller 82 is disposed outside a loop formed by the fixing belt 81. The pressure roller 82 is disposed opposite and in contact with an outer circumferential surface of the fixing belt 81.

The fixing device 80 further includes a nip former 90, a stay 93, a halogen heater pair 85, and a reflector 86, which are disposed inside the loop formed by the fixing belt 81.

The nip former 90 (e.g., a nip forming pad) presses against the pressure roller 82 via the fixing belt 81, forming a fixing nip N between the fixing belt 81 and the pressure roller 82. At the fixing nip N, the fixing belt 81 and the pressure roller 82 sandwich and convey a sheet S serving as a recording medium. The nip former 90 includes a base 91 serving as a resin nip forming member and a thermal equalizer 92 serving as a metal nip forming member.

The base 91 is made of resin.

The thermal equalizer 92 is interposed between the base 91 and the fixing belt 81.

The stay 93 supports the nip former 90 against pressure from the pressure roller 82.

Each of the base 91, the thermal equalizer 92, and the stay 93 has a length not smaller than a length of the fixing belt 81 in an axial direction, that is, a longitudinal direction, of the fixing belt 81.

The thermal equalizer 92 conducts heat in the longitudinal direction of the fixing belt 81 and decreases unevenness of the temperature of the fixing belt 81 in the longitudinal direction thereof.

Hence, the thermal equalizer 92 is preferably made of a material that conducts heat in a shortened time period. For example, the thermal equalizer 92 is preferably made of a material having an increased thermal conductivity, such as copper, aluminum, and silver. Copper is most preferable by comprehensively considering costs, availability, thermal conductivity, and processing.

For example, the thermal equalizer 92 is produced by bending a copper plate having a thickness of about 0.5 mm into a recess. The thickness of the thermal equalizer 92 is exaggerated in FIG. 2, for example.

An inner circumferential surface of the fixing belt 81 slides over the thermal equalizer 92 via a low friction sheet serving as a slide sheet. The low friction sheet is applied with a lubricant such as fluorine grease and silicone oil to decrease a slide torque of the fixing belt 81.

Alternatively, the thermal equalizer 92 may contact the inner circumferential surface of the fixing belt 81 directly.

The halogen heater pair 85 serves as a heat source that heats the fixing belt 81. As illustrated in FIG. 2, the halogen heater pair 85 is constructed of two halogen heaters 85A and 85B.

The halogen heaters 85A and 85B are disposed opposite the inner circumferential surface of the fixing belt 81 in an outboard span that is outboard from the fixing nip N in a circumferential direction of the fixing belt 81, heating the inner circumferential surface of the fixing belt 81 directly with radiant heat.

In order to cause the halogen heaters 85A and 85B to heat the fixing belt 81 efficiently, the reflector 86 is mounted on an inner face of the stay 93. The reflector 86 is platy and reflects light radiated from the halogen heaters 85A and 85B to the fixing belt 81.

In order to improve efficiency with which the halogen heaters 85A and 85B heat the fixing belt 81, the reflector 86 reflects radiant heat and the like from the halogen heaters 85A and 85B, for example, suppressing heating of the stay 93 with the radiant heat and the like and resultant waste of energy.

The pressure roller 82 includes a hollow, metal roller 83 and a rubber layer 84 made of silicone rubber and mounted on the metal roller 83.

In order to facilitate separation of toner of the toner image on the sheet S, a release layer is mounted on a surface of the rubber layer 84. The release layer is made of perfluoroalkoxy alkane (PFA) or polytetrafluoroethylene (PTFE) and has a layer thickness in a range of from 5 μm to 50 μm.

A driving force is transmitted to the pressure roller 82 from a driver such as a motor disposed in the image forming apparatus 100 through a gear, thus rotating the pressure roller 82 in a rotation direction D82.

A spring or the like presses the pressure roller 82 against the fixing belt 81. As the spring presses and deforms the rubber layer 84 of the pressure roller 82, the pressure roller 82 forms the fixing nip N having a predetermined length in a sheet conveyance direction T in which the sheet S is conveyed.

The pressure roller 82 may be a solid roller or a hollow roller. However, the hollow roller preferably has a decreased thermal capacity. A heat source such as a halogen heater may be disposed inside the pressure roller 82 as the hollow roller.

The rubber layer 84 may be made of solid rubber. Alternatively, if no heater is disposed inside the pressure roller 82, sponge rubber may be used.

The sponge rubber enhances thermal insulation of the pressure roller 82, preferably causing the pressure roller 82 to draw less heat from the fixing belt 81.

The fixing belt 81 is an endless belt or film made of metal such as nickel and stainless used steel (SUS) or resin such as polyimide. The fixing belt 81 has a layer thickness in a range of from 30 μm to 50 μm.

The fixing belt 81 includes a base and a release layer. The release layer serves as a surface layer made of PFA, PTFE, or the like, facilitating separation of toner of the toner image on the sheet S from the fixing belt 81 and preventing the toner from adhering to the fixing belt 81.

Optionally, an elastic layer made of silicone rubber or the like may be interposed between the base and the release layer.

If the fixing belt 81 does not incorporate the elastic layer, the fixing belt 81 attains a decreased thermal capacity that improves a fixing property of being heated quickly. However, when the pressure roller 82 presses and deforms an unfixed toner image to fix the toner image on the sheet S, slight surface asperities of the fixing belt 81 may be transferred onto the toner image, causing a disadvantage that uneven gloss of the toner image remains on a solid part of the toner image as uneven fixing.

To address this circumstance, the elastic layer has a thickness of 100 μm or more. As the elastic layer deforms, the elastic layer absorbs the slight surface asperities, preventing uneven fixing.

As the pressure roller 82 frictionally contacts the fixing belt 81 and rotates, the fixing belt 81 rotates in accordance with rotation of the pressure roller 82.

The fixing belt 81 rotates while the nip former 90 and the pressure roller 82 sandwich the fixing belt 81 at the fixing nip N. Both lateral ends of the fixing belt 81 in the axial direction thereof are supported to retain a tubular shape in the outboard span that is outboard from the fixing nip N in the circumferential direction of the fixing belt 81. Thus, the fixing belt 81 retains a circular shape in cross section stably.

A separator is disposed downstream from the fixing nip N in the sheet conveyance direction T. The separator separates the sheet S from the fixing belt 81.

As illustrated in FIG. 2, according to this embodiment, the fixing nip N is planar. Alternatively, the fixing nip N may be curved to define a projection that projects from the pressure roller 82 toward the fixing belt 81 or may have other shapes.

If the fixing nip N is recessed toward the fixing belt 81, the fixing nip N directs the leading edge of the sheet S to the pressure roller 82 when the sheet S is ejected from the fixing nip N, facilitating separation of the sheet S from the fixing belt 81 and thereby preventing the sheet S from being jammed. If the fixing nip N is straight, the fixing nip N provides adjustment properly such as improvement in conveyance of an envelope.

Alternatively, an opposed face of the base 91, which is disposed opposite the pressure roller 82, may be recessed and the thermal equalizer 92 may fit to the recessed, opposed face of the base 91.

The stay 93 prevents the nip former 90 from being bent by pressure from the pressure roller 82, attaining a uniform length of the fixing nip N in the sheet conveyance direction T throughout an entire span of the fixing belt 81 in the axial direction thereof.

According to this embodiment, the pressure roller 82 is pressed against the fixing belt 81 to form the fixing nip N therebetween. Alternatively, the nip former 90 may be pressed against the pressure roller 82 via the fixing belt 81 to form the fixing nip N between the fixing belt 81 and the pressure roller 82.

The stay 93 has a mechanical strength great enough to support the nip former 90 and prevent the nip former 90 from being bent. The stay 93 is preferably made of metal having an enhanced mechanical strength such as stainless steel and iron or metal oxide such as ceramics.

A description is provided of an embodiment of the fixing device 80.

As described above, the fixing device 80 includes the nip former 90 and the stay 93 serving as a support. The nip former 90 includes a resin nip forming member (e.g., the base 91) and a metal nip forming member (e.g., the thermal equalizer 92). The resin nip forming member is made of resin. The metal nip forming member is made of metal and interposed between the resin nip forming member and a fixing rotator (e.g., the fixing belt 81).

The metal nip forming member includes a contact face that is disposed in at least a part of a lateral end span of the metal nip forming member in an axial direction of the fixing rotator. The contact face contacts a metal member of the support. Alternatively, the contact face may contact a thermal conductor that conducts heat to the metal member of the support.

The support includes at least the metal member. The support may be a combination of the metal member and other member.

Accordingly, the fixing device 80 decreases uneven temperature of the fixing rotator in the axial direction thereof, attains a decreased thermal capacity, and shortens a warmup time with a simple construction. For example, a plane of the metal nip forming member made of metal having an enhanced thermal conductivity contacts the fixing rotator directly or indirectly, facilitating thermal equalization of the fixing rotator in the axial direction thereof and suppressing temperature increase of each lateral end span of the fixing rotator in the axial direction thereof when a plurality of small sheets S is conveyed over the fixing rotator. Additionally, the resin nip forming member has a decreased thermal conductivity, suppressing heat radiation to a part of the fixing device 80 other than the fixing nip N and shortening the warmup time. Further, the contact face of the metal nip forming member, which is disposed in each lateral end span of the metal nip forming member in the axial direction of the fixing rotator, contacts the support having an increased thermal capacity, suppressing temperature increase of each lateral end span of the fixing rotator in the axial direction thereof when a plurality of small sheets S is conveyed over the fixing rotator.

Figure 3:
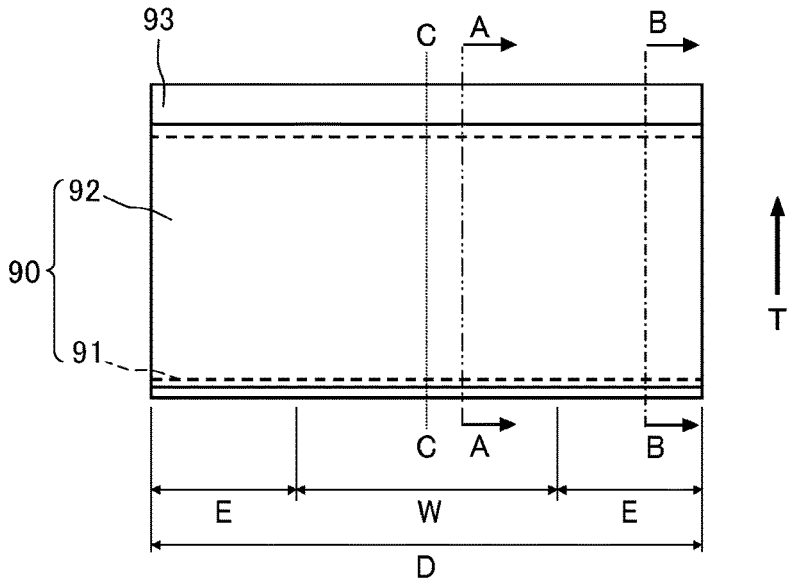
FIG. 3 is a diagram of a nip former and a stay incorporated in the fixing device depicted in FIG. 2 for explaining a longitudinal direction of the nip former.

Referring to FIG. 3, a description is provided of each lateral end span in the axial direction of the fixing rotator.

FIG. 3 is a diagram of the nip former 90 for explaining a longitudinal direction thereof, that is parallel to the axial direction of the fixing rotator (e.g., the fixing belt 81). FIG. 3 illustrates the nip former 90 and the stay 93 seen from the fixing nip N or the pressure roller 82 depicted in FIG. 2. The thermal equalizer 92 is mounted on the base 91 mounted on the stay 93 and is closer to the fixing nip N than the base 91 and the stay 93 are. FIG. 3 illustrates the base 91 with a dotted line.

A sheet S serving as a recording medium is conveyed in the sheet conveyance direction T, that is, a short direction of the nip former 90. An axial direction D of the fixing belt 81, that is, the longitudinal direction of the nip former 90, is perpendicular to the sheet conveyance direction T.

A center span of the nip former 90 (e.g., the thermal equalizer 92) is within a width span W centered on a center of the nip former 90 in the axial direction D of the fixing belt 81, that is, the longitudinal direction of the nip former 90. The width span W has a width defined with a positive number in millimeters. In FIG. 3, a line C-C defines the center of the nip former 90 in the longitudinal direction thereof parallel to the axial direction D of the fixing belt 81. The line C-C defines a center of the width span Win the axial direction D of the fixing belt 81.

Each of lateral end spans E is disposed outboard from the center span of the nip former 90 in the axial direction D of the fixing belt 81. For example, each of the lateral end spans E is disposed outboard from the width span W in the axial direction D of the fixing belt 81.

The center span and the lateral end span E do define different spans, respectively, in the axial direction D of the fixing belt 81 and do not define different spans, respectively, in the short direction of the nip former 90 unless otherwise specified.

In embodiments described below, the center span in the axial direction D of the fixing belt 81 is illustrated in a cross section taken on a line A-A. The lateral end span E in the axial direction D of the fixing belt 81 is illustrated in a cross section taken on a line B-B. The line A-A and the line B-B illustrated in FIG. 3 are one example. The line A-A and the line B-B may be situated at other positions as long as the line A-A is situated within the center span (e.g., the width span W) in the axial direction D of the fixing belt 81 and the line B-B is situated within the lateral end span E disposed outboard from the width span W in the axial direction D of the fixing belt 81.

FIG. 3 illustrates an example of layering of the thermal equalizer 92, the base 91, and the stay 93 depicted in FIG. 2, which may not be in conformity with examples of layering according to the embodiments described below. The size, the positional relation, and the like of the thermal equalizer 92, the base 91, and the stay 93 are not limited to those described below.

In each of the embodiments below, a description is provided of an example of a construction of a nip former and a stay incorporated in a fixing device according to an embodiment of the present disclosure. The stay according to each of the embodiments described below with reference to drawings includes a metal member.

Figure 4A:
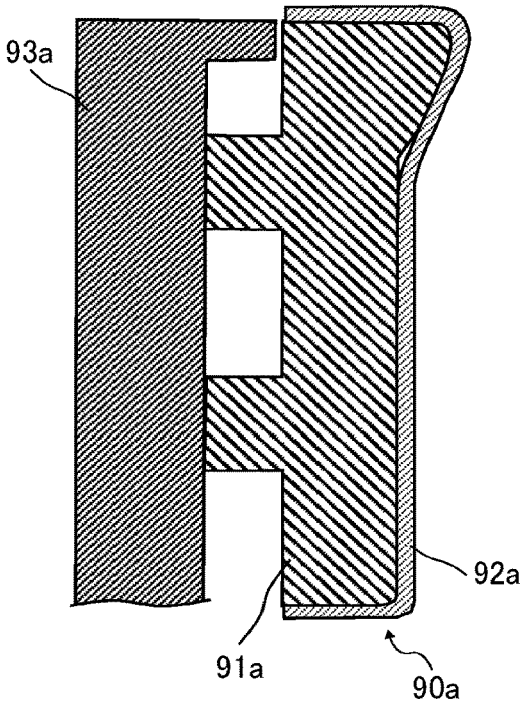
FIG. 4A is a diagram of a nip former and a stay according to a first embodiment of the present disclosure, that are installable in the fixing device depicted in FIG. 2, illustrating a center span of the nip former and the stay in a longitudinal direction of the nip former.
Figure 4B:
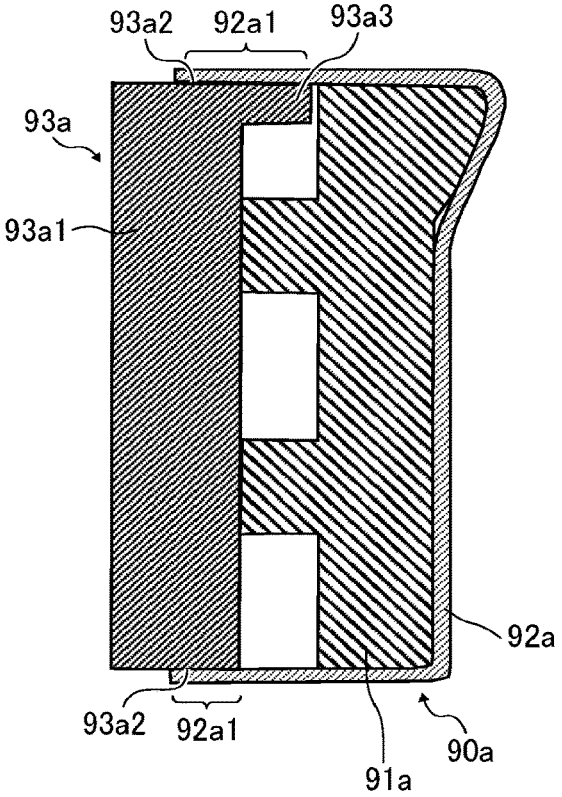
FIG. 4B is a diagram of the nip former and the stay depicted in FIG. 4A, illustrating a lateral end span of the nip former and the stay in the longitudinal direction of the nip former.

Referring to FIGS. 4A and 4B, a description is provided of a construction of a nip former 90*a* and a stay 93*a* according to a first embodiment of the present disclosure.

Figure 4C:
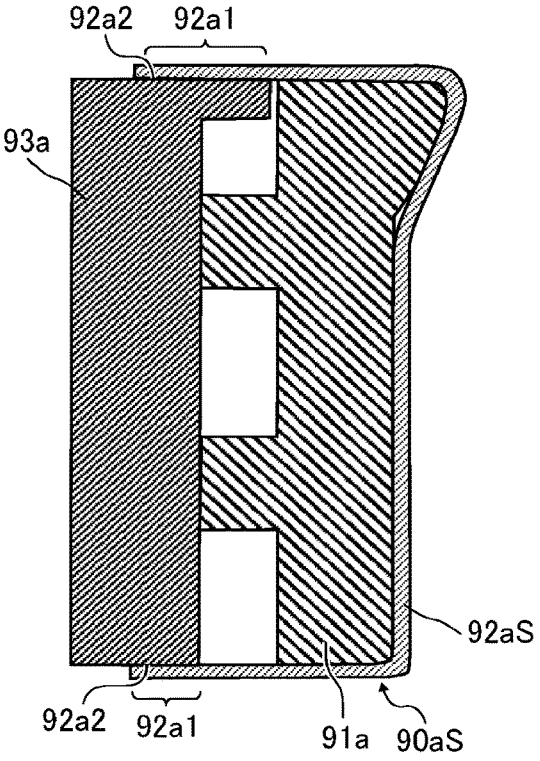
FIG. 4C is a diagram of a variation of the nip former depicted in FIG. 4B, illustrating a thermal conduction aid applied to the nip former.

FIGS. 4A and 4B illustrate an example of the construction of the nip former 90*a* and the stay 93*a* according to the first embodiment. FIG. 4A is a cross-sectional view of the nip former 90*a* and the stay 93*a* in the center span (e.g., the width span W) in the axial direction D of the fixing belt 81 depicted in FIG. 3. FIG. 4B is a cross-sectional view of the nip former 90*a* and the stay 93*a* in the lateral end span E in the axial direction D of the fixing belt 81 depicted in FIG. 3. As illustrated in FIGS. 4A and 4B, the nip former 90*a* includes a base 91*a* and a thermal equalizer 92*a* mounted on the base 91*a*. FIG. 4C is a cross-sectional view of a nip former 90*a*S and the stay 93*a* in the lateral end span E in the axial direction D of the fixing belt 81 depicted in FIG. 3. The nip former 90*a*S is a variation of the nip former 90*a* depicted in FIGS. 4A and 4B.

As illustrated in FIG. 4B, in the lateral end span E in the axial direction D of the fixing belt 81, the thermal equalizer 92*a* is bent at and extended from both ends (e.g., an upper portion and a lower portion of the thermal equalizer 92*a* in FIG. 4B) in a short direction thereof. The upper portion and the lower portion in FIG. 4B are a downstream portion and an upstream portion of the thermal equalizer 92*a* in the sheet conveyance direction T, respectively. The stay 93*a* includes a metal member 93*a*1 having planes 93*a*2. The thermal equalizer 92*a* includes contact faces 92*a*1 that contact the planes 93*a*2, respectively. The contact faces 92*a*1 are disposed outboard from the fixing nip N in the short direction of the thermal equalizer 92*a*.

Figure 5:
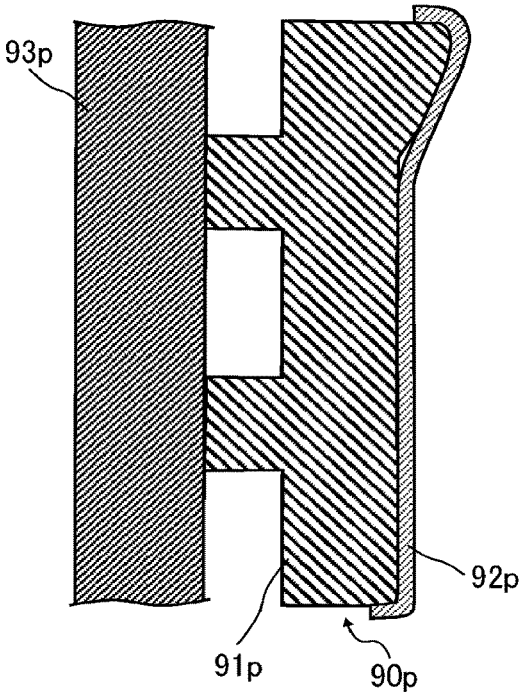
FIG. 5 is a diagram of a comparative nip former and a stay, illustrating an example of a construction thereof.

FIG. 5 is a diagram of a comparative nip former 90*p* and a stay 93*p*, illustrating an example of a construction thereof. The comparative nip former 90*p* includes a base 91*p* and a thermal equalizer 92*p*. The thermal equalizer 92*p* achieves an advantage of suppressing temperature increase of both lateral end spans of a fixing rotator (e.g., the fixing belt 81) in an axial direction thereof. However, if the thermal equalizer 92*p* made of metal has an increased thickness to improve the advantage, a warmup time to warm up the fixing rotator or heat the fixing rotator to a fixing temperature may lengthen, generating a trade-off relation between the thickness of the thermal equalizer 92*p* and the warmup time.

To address this circumstance, according to the first embodiment of the present disclosure depicted in FIG. 4B, even if the thickness of the thermal equalizer 92*a* does not change, the contact faces 92*a*1 of the thermal equalizer 92*a* contact the planes 93*a*2 of the metal member 93*a*1 of the stay 93*a*, respectively, thus suppressing temperature increase of each lateral end span of the fixing belt 81 in the axial direction D thereof.

As illustrated in FIG. 4B, the stay 93*a* includes a projection 93*a*3 disposed at an upper portion of the stay 93*a* in FIG. 4B (e.g., a downstream portion of the stay 93*a* in the sheet conveyance direction T). The projection 93*a*3 defines an upper face of the stay 93*a*, that contacts the contact face 92*a*1 of the thermal equalizer 92*a*. The projection 93*a*3 projects toward the base 91*a* along the contact face 92*a*1 of the thermal equalizer 92*a*, increasing an area where the stay 93*a* contacts the contact face 92*a*1 of the thermal equalizer 92*a*. Accordingly, an increased amount of heat is conducted from the thermal equalizer 92*a* to the stay 93*a*. The stay 93*a* may include another projection 93*a*3 disposed at a lower portion of the stay 93*a* in FIG. 4B (e.g., an upstream portion of the stay 93*a* in the sheet conveyance direction T). The another projection 93*a*3 defines a lower face of the stay 93*a*, that contacts the contact face 92*a*1 of the thermal equalizer 92*a*.

As illustrated in FIG. 4B, in the lateral end span E in the axial direction D of the fixing belt 81, the thermal equalizer 92*a* extends from both ends in the short direction thereof. The thermal equalizer 92*a* includes the contact faces 92*a*1 disposed in the upper portion and the lower portion of the thermal equalizer 92*a* in FIG. 4B, respectively. Alternatively, the thermal equalizer 92*a* may include the contact face 92*a*1 disposed in one of the upper portion and the lower portion of the thermal equalizer 92*a* in FIG. 4B. The contact face 92*a*1 contacts the stay 93*a*.

The contact face 92*a*1 may extend in the axial direction D of the fixing belt 81 throughout the entire lateral end span E or in a part of the lateral end span E. Further, the thermal equalizer 92*a* may include the contact face 92*a*1 disposed in one of the two lateral end spans E in the axial direction D of the fixing belt 81.

FIG. 4C illustrates the nip former 90*a*S that includes the base 91*a* and a thermal equalizer 92*a*S. As illustrated in FIG. 4C, the thermal equalizer 92*a*S includes the contact faces 92*a*1 each of which is applied with a thermal conduction aid 92*a*2 such as thermally conductive grease, facilitating conduction of heat from the thermal equalizer 92*a*S to the stay 93*a* more effectively.

Figure 6A:
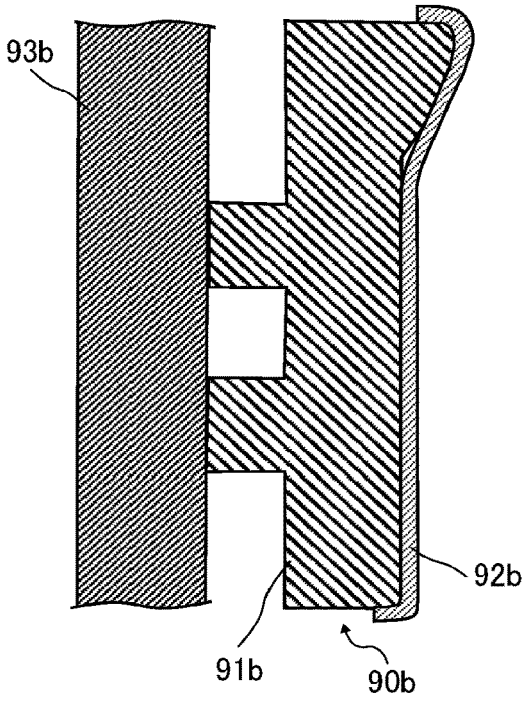
FIG. 6A is a diagram of a nip former and a stay according to a second embodiment of the present disclosure, that are installable in the fixing device depicted in FIG. 2, illustrating a center span of the nip former and the stay in a longitudinal direction of the nip former.
Figure 6B:
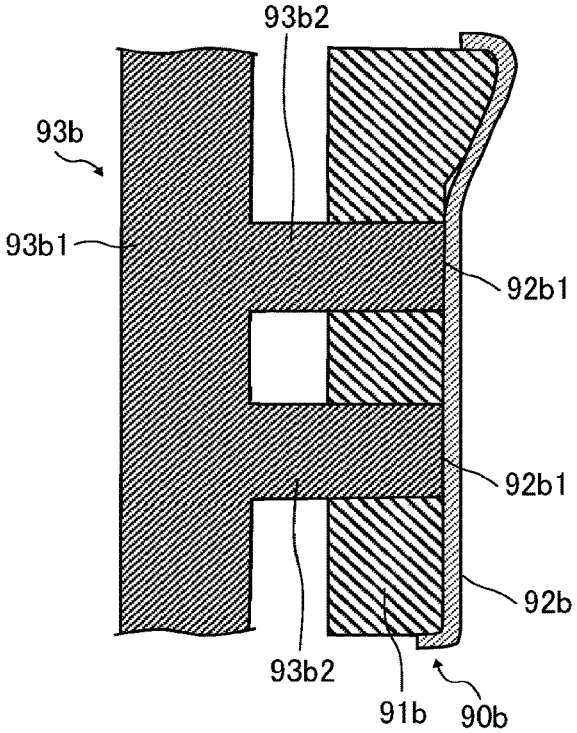
FIG. 6B is a diagram of the nip former and the stay depicted in FIG. 6A, illustrating a lateral end span of the nip former and the stay in the longitudinal direction of the nip former.

Referring to FIGS. 6A and 6B, a description is provided of a construction of a nip former 90*b* and a stay 93*b* according to a second embodiment of the present disclosure.

FIGS. 6A and 6B illustrate an example of the construction of the nip former 90*b* and the stay 93*b* according to the second embodiment. FIG. 6A is a cross-sectional view of the nip former 90*b* and the stay 93*b* in the center span (e.g., the width span W) in the axial direction D of the fixing belt 81 depicted in FIG. 3. FIG. 6B is a cross-sectional view of the nip former 90*b* and the stay 93*b* in the lateral end span E in the axial direction D of the fixing belt 81 depicted in FIG. 3. As illustrated in FIGS. 6A and 6B, the nip former 90*b* includes a base 91*b* and a thermal equalizer 92*b* mounted on the base 91*b*. The stay 93*b* includes a metal member 93*b*1.

As illustrated in FIG. 6B, in the lateral end span E in the axial direction D of the fixing belt 81, the stay 93*b* includes projections 93*b*2 that project toward the fixing nip N and contact the thermal equalizer 92*b*.

The projections 93*b*2 penetrate through the base 91*b* and reach the thermal equalizer 92*b*. The thermal equalizer 92*b* contacts opposed faces of the projections 93*b*2, that are disposed opposite the thermal equalizer 92*b*. Hence, the thermal equalizer 92*b* includes contact faces 92*b*1 that are disposed in a nip span where the fixing nip N is situated.

FIG. 6B illustrates the two projections 93*b*2. However, the number of the projections 93*b*2 may be one or more. The projection 93*b*2 may extend in the axial direction D of the fixing belt 81 throughout the entire lateral end span E or in a part of the lateral end span E. Further, the thermal equalizer 92*b* may include the contact faces 92*b*1 disposed in one of the two lateral end spans E in the axial direction D of the fixing belt 81.

The thermal equalizer 92*b* may further include the contact faces 92*a*1 depicted in FIG. 4B.

Figure 7A:
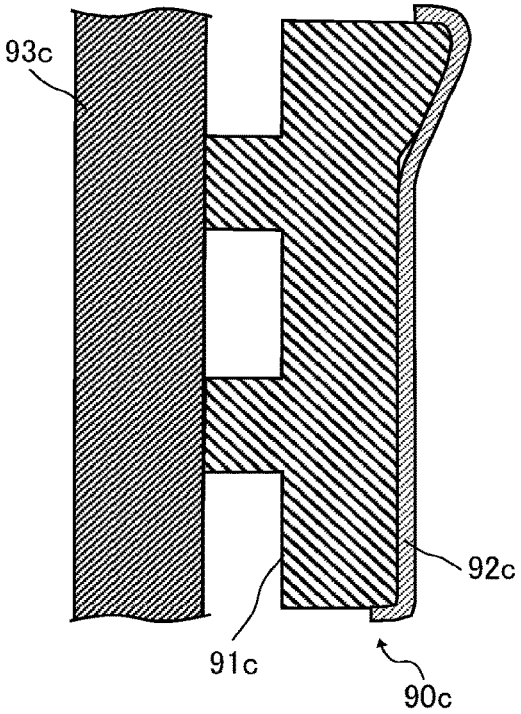
FIG. 7A is a diagram of a nip former and a stay according to a third embodiment of the present disclosure, that are installable in the fixing device depicted in FIG. 2, illustrating a center span of the nip former and the stay in a longitudinal direction of the nip former.
Figure 7B:
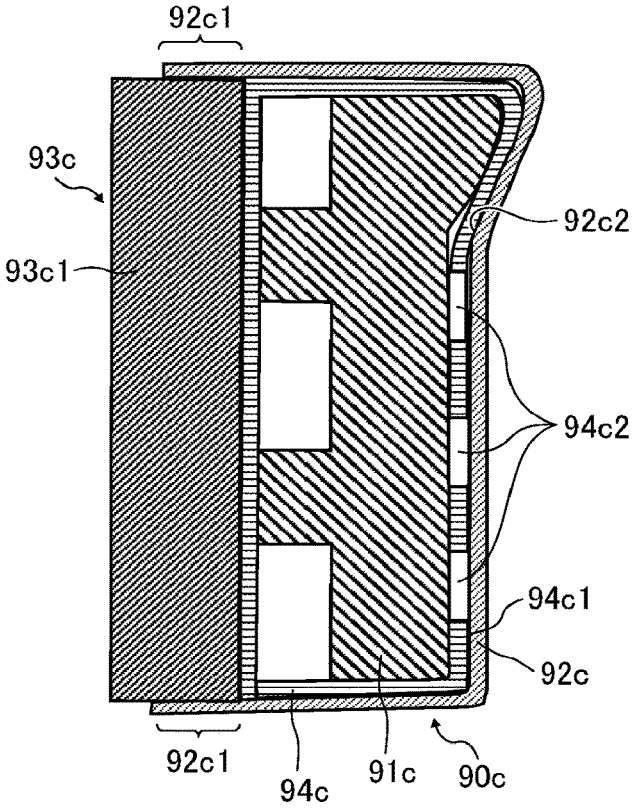
FIG. 7B is a diagram of the nip former and the stay depicted in FIG. 7A, illustrating a lateral end span of the nip former and the stay in the longitudinal direction of the nip former.

Referring to FIGS. 7A and 7B, a description is provided of a construction of a nip former 90*c* and a stay 93*c* according to a third embodiment of the present disclosure.

FIGS. 7A and 7B illustrate an example of the construction of the nip former 90*c* and the stay 93*c* according to the third embodiment. FIG. 7A is a cross-sectional view of the nip former 90*c* and the stay 93*c* in the center span (e.g., the width span W) in the axial direction D of the fixing belt 81 depicted in FIG. 3. FIG. 7B is a cross-sectional view of the nip former 90*c* and the stay 93*c* in the lateral end span E in the axial direction D of the fixing belt 81 depicted in FIG. 3.

As illustrated in FIGS. 7A and 7B, the nip former 90*c* includes a thermal diffuser 94*c* in addition to a base 91*c* and a thermal equalizer 92*c*.

The thermal diffuser 94*c*, serving as a thermal conductor, is made of metal and contacts a metal member 93*c*1 of the stay 93*c* and the thermal equalizer 92*c*. For example, the thermal equalizer 92*c* includes a contact face 92*c*2 that contacts the thermal diffuser 94*c* in the lateral end span E of the nip former 90*c* in a longitudinal direction thereof.

Like the thermal equalizer 92*a* depicted in FIG. 4B, the thermal equalizer 92*c* further includes contact faces 92*c*1 that contact the stay 93*c*. The contact faces 92*c*1 are disposed in an upper portion and a lower portion of the thermal equalizer 92*c* in FIG. 7B, that is, a downstream portion and an upstream portion of the thermal equalizer 92*c* in the sheet conveyance direction T, respectively.

The thermal equalizer 92*c* diffuses heat to the stay 93*c* through the thermal diffuser 94*c* in addition to the contact faces 92*c*1, suppressing temperature increase of each lateral end span of the fixing belt 81 in the axial direction D thereof more effectively.

As illustrated in FIG. 7B, the thermal diffuser 94*c* surrounds the base 91*c* in each lateral end span E in the axial direction D of the fixing belt 81. In each lateral end span E in the axial direction D of the fixing belt 81, the thermal diffuser 94*c* includes holes 94*c*2 (e.g., a hole, a through hole, and an opening) disposed partially in a contact face 94*c*1 that contacts the thermal equalizer 92*c*. The holes 94*c*2 disposed opposite the thermal equalizer 92*c* define hollows where the thermal diffuser 94*c* is not situated.

Alternatively, like a thermal diffuser 94*d* described below with reference to FIG. 8B, the contact face 94*c*1 of the thermal diffuser 94*c* may contact the contact face 92*c*2 of the thermal equalizer 92*c* entirely.

Further, the nip former 90*c* may include the thermal diffuser 94*c* or the contact faces 92*c*1 disposed in one of the two lateral end spans E in the axial direction D of the fixing belt 81.

Figure 8A:
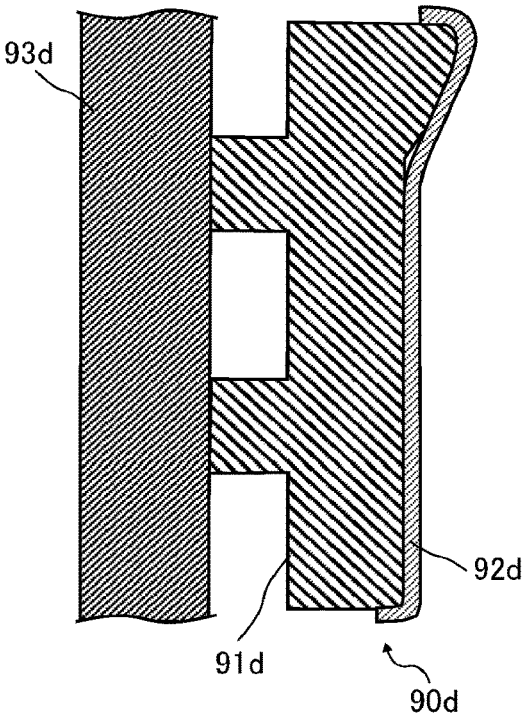
FIG. 8A is a diagram of a nip former and a stay according to a fourth embodiment of the present disclosure, that are installable in the fixing device depicted in FIG. 2, illustrating a center span of the nip former and the stay in a longitudinal direction of the nip former.
Figure 8B:
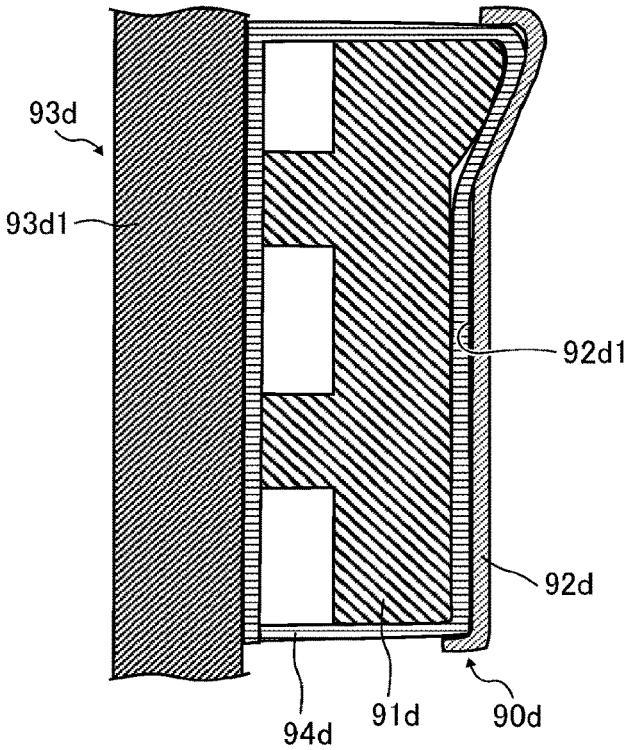
FIG. 8B is a diagram of the nip former and the stay depicted in FIG. 8A, illustrating a lateral end span of the nip former and the stay in the longitudinal direction of the nip former.

Referring to FIGS. 8A and 8B, a description is provided of a construction of a nip former 90*d* and a stay 93*d* according to a fourth embodiment of the present disclosure.

FIGS. 8A and 8B illustrate an example of the construction of the nip former 90*d* and the stay 93*d* according to the fourth embodiment. FIG. 8A is a cross-sectional view of the nip former 90*d* and the stay 93*d* in the center span (e.g., the width span W) in the axial direction D of the fixing belt 81 depicted in FIG. 3. FIG. 8B is a cross-sectional view of the nip former 90*d* and the stay 93*d* in the lateral end span E in the axial direction D of the fixing belt 81 depicted in FIG. 3.

The nip former 90*d* according to the fourth embodiment includes a thermal equalizer 92*d* that does not incorporate contact faces unlike the thermal equalizer 92*c* of the nip former 90*c* according to the third embodiment, that includes the contact faces 92*c*1.

As illustrated in FIGS. 8A and 8B, the nip former 90*d* includes the thermal diffuser 94*d* in addition to a base 91*d* and the thermal equalizer 92*d*.

The thermal diffuser 94*d*, serving as a thermal conductor, is made of metal and contacts a metal member 93*d*1 of the stay 93*d* and the thermal equalizer 92*d*.

The thermal equalizer 92*d* includes a contact face 92*d*1 that contacts the thermal diffuser 94*d*, diffusing heat to the stay 93*d* through the thermal diffuser 94*d*. For example, the contact face 92*d*1 of the thermal equalizer 92*d* contacts the thermal diffuser 94*d* in the lateral end span E of the nip former 90*d* in a longitudinal direction thereof.

Like the thermal diffuser 94*c* described above with reference to FIG. 7B, the thermal diffuser 94*d* may include holes.

A description is provided of other embodiments of the present disclosure.

Each lateral end span E is disposed outboard from a center span of a nip former (e.g., the nip formers 90, 90*a*, 90*b*, 90*c*, and 90*d*) in a longitudinal direction thereof. The center span of the nip former is preferably 180 mm. The center span of the nip former is more preferably 210 mm.

It is because a sheet S conveyed over the fixing belt 81 in the center span draws heat from the center span of the fixing belt 81 but the sheet S does not draw heat from the lateral end spans E of the fixing belt 81. Hence, the fixing belt 81 stores heat in the lateral end spans E. To address this circumstance, heat is preferably diffused from the lateral end spans E disposed outboard from sheets S of frequently used sizes, that is, a sheet S of an A4 size having a width of 210 mm and a sheet S of a B5 size having a width of 182 mm, in the axial direction D of the fixing belt 81. The lateral end spans E may not be precisely outboard from the sheets S of the A4 size and the B5 size conveyed over the fixing belt 81. For example, in view of diffusing performance and the like, the lateral end spans E may be inboard or outboard from the center span where the sheets S of the A4 size and the B5 size are conveyed by about plus or minus 10 mm in the axial direction D of the fixing belt 81.

Figure 9:
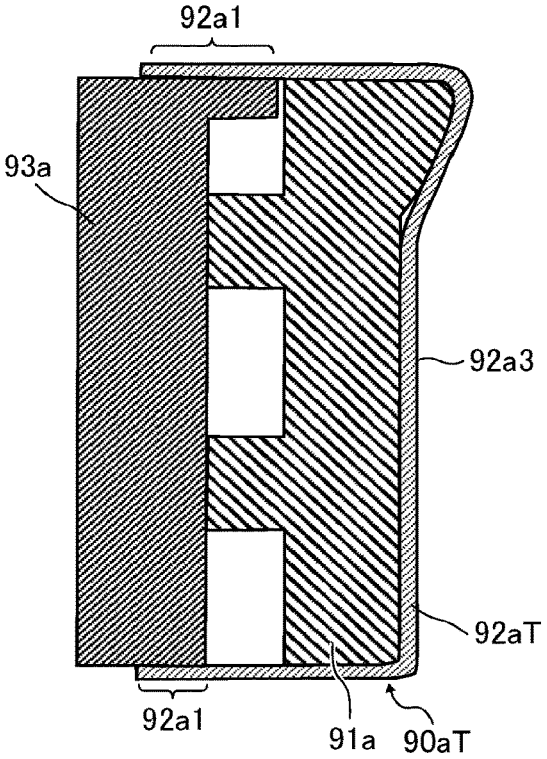
FIG. 9 is a diagram of a variation of the nip former depicted in FIG. 4B, illustrating a fluororesin coating layer incorporated in the nip former.

FIG. 9 illustrates a nip former 90*a*T including a thermal equalizer 92*a*T. As illustrated in FIG. 9, the thermal equalizer 92*a*T serving as a metal nip forming member preferably includes a fluororesin coating layer 92*a*3 as a surface layer made of fluororesin. The fluororesin coating layer 92*a*3 reduces a contact resistance between a nip former (e.g., the nip former 90*a*T) and a fixing rotator (e.g., the fixing belt 81) that contacts the nip former, preventing abrasion of the fixing rotator. The fluororesin coating layer 92*a*3 may be also applicable to the thermal equalizers 92*b*, 92*c*, and 92*d*.

An area of a contact face (e.g., the contact faces 92*a*1, 92*b*1, 92*c*1, 92*c*2, and 92*d*1) preferably changes in a longitudinal direction of a nip former (e.g., the nip formers 90*a*, 90*b*, 90*c*, and 90*d*). For example, a contact area where a metal nip forming member (e.g., the thermal equalizers 92*a*, 92*b*, and 92*c*) contacts a support (e.g., the stays 93*a*, 93*b*, and 93*c*) changes in the longitudinal direction of the nip former. A contact area where the metal nip forming member contacts the support at least in each of the lateral end spans E outboard from the center span, where the sheets S of major sizes (e.g., the A4 size and the B5 size) are conveyed, in the longitudinal direction of the nip former is greater than a contact area where the metal nip forming member contacts the support in other span.

Thus, the metal nip forming member and the support prevent overheating of the fixing rotator in the lateral end spans E.

According to the embodiments described above, the metal nip forming member, that has a deceased thickness not to adversely affect temperature increase, includes the contact face that contacts the support including a metal member (e.g., the metal members 93*a*1, 93*b*1, 93*c*1, and 93*d*1), thus suppressing temperature increase of each lateral end span of a fixing rotator (e.g., the fixing belt 81) in the axial direction D thereof. Accordingly, the contact face of the metal nip forming member, which is disposed in each lateral end span E of the metal nip forming member in the axial direction D of the fixing rotator, contacts the support having an increased thermal capacity, suppressing temperature increase of each lateral end span of the fixing rotator in the axial direction D thereof when a plurality of small sheets S is conveyed over the fixing rotator. Consequently, the nip former disposed opposite the entire fixing nip N incorporates a metal member, that is, the metal nip forming member, that has a decreased thickness and an increased thermal capacity that conducts heat from the lateral end spans E of the metal nip forming member in the axial direction D of the fixing rotator to another metal member, that is, the metal member of the support.

The contact face of the metal nip forming member has an area that changes arbitrarily in the axial direction D of the fixing rotator, varying thermal equalization in a longitudinal direction of the metal nip forming member and enhancing thermal equalization in a desired span. For example, the desired span is each of the lateral end spans E outboard from the center span in the axial direction D of the fixing rotator. The center span is a conveyance span where the sheets S of the major sizes are conveyed over the fixing rotator. As a result, a fixing device (e.g., the fixing device 80) achieves an advantage of warming up the fixing rotator quickly and another advantage of suppressing degradation in productivity caused by overheating in the lateral end spans E outboard from the conveyance span in the axial direction D of the fixing rotator where the sheets S are conveyed over the fixing rotator with a simple construction.

The above describes the embodiments of the present disclosure specifically. However, the technology of the present disclosure is not limited to the embodiments described above and is modified within the scope of the present disclosure.

A description is provided of advantages of a fixing device (e.g., the fixing device 80).

As illustrated in FIGS. 2, 3, 4B, 4C, 6B, 7B, 8B, and 9, the fixing device includes a fixing rotator (e.g., the fixing belt 81), a heat source (e.g., the halogen heater 85A), a pressure rotator (e.g., the pressure roller 82), a nip former (e.g., the nip formers 90, 90*a*, 90*a*S, 90*b*, 90*c*, 90*d*, and 90*a*T), and a support (e.g., the stays 93, 93*a*, 93*b*, 93*c*, and 93*d*).

The fixing rotator is rotatable. The heat source heats the fixing rotator. The pressure rotator contacts an outer circumferential surface of the fixing rotator. The nip former is disposed opposite an inner circumferential surface of the fixing rotator. The nip former is disposed opposite or pressed against the pressure rotator via the fixing rotator to form a nip (e.g., the fixing nip N) between the fixing rotator and the pressure rotator. The support includes a metal member (e.g., the metal members 93*a*1, 93*b*1, 93*c*1, and 93*d*1) and supports the nip former.

The nip former includes a resin nip forming member (e.g., the bases 91, 91*a*, 91*b*, 91*c*, and 91*d*) and a metal nip forming member (e.g., the thermal equalizers 92, 92*a*, 92*a*S, 92*b*, 92*c*, 92*d*, and 92*a*T). The resin nip forming member is made of resin. The metal nip forming member is made of metal and is interposed between the resin nip forming member and the fixing rotator. The metal nip forming member includes a contact face (e.g., the contact faces 92*a*1, 92*b*1, and 92*c*1) that is disposed in at least a part of a lateral end span (e.g., the lateral end span E) of the metal nip forming member in a longitudinal direction thereof or an axial direction (e.g., the axial direction D) of the fixing rotator. The contact face contacts the metal member of the support.

Accordingly, the fixing device decreases uneven temperature of the fixing rotator in the axial direction thereof and shortens a warmup time of the fixing rotator with a simple construction.

According to the embodiments described above, the fixing device 80 employs a center conveyance system in which a recording medium (e.g., a sheet S) is centered at a center of the fixing belt 81 in the axial direction D thereof such that the recording medium is conveyed over the conveyance span, that is, the center span of the fixing belt 81 in the axial direction D thereof. Thus, the two lateral end spans E are disposed outboard from the center span of the fixing belt 81 in the axial direction D thereof such that the center span is interposed between the two lateral end spans E in the axial direction D of the fixing belt 81.

Alternatively, the fixing device 80 may employ a lateral end conveyance system in which the recording medium is aligned along a lateral end of the fixing belt 81 in the axial direction D thereof. Thus, the single lateral end span E is disposed outboard from the conveyance span in the axial direction D of the fixing belt 81.

According to the embodiments described above, the fixing belt 81 serves as a fixing rotator. Alternatively, a fixing film, a fixing sleeve, or the like may be used as a fixing rotator. Further, the pressure roller 82 serves as a pressure rotator. Alternatively, a pressure belt or the like may be used as a pressure rotator.

According to the embodiments described above, the image forming apparatus 100 is a printer. Alternatively, the image forming apparatus 100 may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A fixing device comprising:

a fixing rotator to rotate;

a heat source to heat the fixing rotator;

a pressure rotator to contact an outer circumferential surface of the fixing rotator;

a nip former disposed opposite the pressure rotator via the fixing rotator to form a nip between the fixing rotator and the pressure rotator; and a support to support the nip former against pressure from the pressure rotator, the support including a metal, the nip former including:

a resin nip former made of resin; and a metal nip former made of metal and interposed between the resin nip former and the fixing rotator, the metal nip former including a contact face disposed in at least a part of a lateral end span of the nip former in a longitudinal direction of the nip former, the contact face to contact the metal of the support, the metal nip former structured to be wider than the support in a direction orthogonal to the longitudinal direction and to contact a front face of the resin nip former, a side face of the support, and without contacting a back face of the support which faces away from the resin nip former.

2. The fixing device according to claim 1, wherein the lateral end span of the nip former is disposed outboard from a center span of the nip former in the longitudinal direction of the nip former.

3. The fixing device according to claim 2, wherein the center span of the nip former has a length of 180 mm.

4. The fixing device according to claim 2, wherein the center span of the nip former has a length of 210 mm.

5. The fixing device according to claim 1, wherein the contact face of the metal nip former is disposed outboard from the nip in a short direction of the nip former.

6. The fixing device according to claim 1, wherein the support further includes a projection projecting toward the nip, the projection to contact the contact face of the metal nip former.

7. The fixing device according to claim 1, wherein the metal nip former further includes a surface coating layer made of fluororesin.

8. The fixing device according to claim 1, wherein an area of the contact face of the metal nip former is to change in the longitudinal direction of the nip former.

9. The fixing device according to claim 1, wherein the nip former further includes a thermal conductor made of metal, the thermal conductor to contact the metal of the support and the metal nip former.

10. The fixing device according to claim 9, wherein the contact face of the metal nip former is to contact the thermal conductor in at least the part of the lateral end span of the nip former in the longitudinal direction of the nip former.

11. The fixing device according to claim 9, wherein the thermal conductor includes a hole disposed opposite the metal nip former.

12. The fixing device according to claim 1, wherein the contact face of the metal nip former includes a thermal conduction aid.

13. The fixing device according to claim 12, wherein the thermal conduction aid includes thermally conductive grease.

14. The fixing device according to claim 1, wherein the support includes a stay.

15. The fixing device according to claim 1, wherein the resin nip former includes a base, and wherein the metal nip former includes a copper plate.

16. A fixing device comprising:

a fixing rotator to rotate;

a heat source to heat the fixing rotator;

a pressure rotator to contact an outer circumferential surface of the fixing rotator, a nip former disposed opposite the pressure rotator via the fixing rotator to form a nip between the fixing rotator and the pressure rotator; and a support to support the nip former against pressure from the pressure rotator, the support including a metal, the nip former including:

a resin nip former made of resin;

a metal nip former made of metal and interposed between the resin nip former and the fixing rotator; and a thermal conductor made of metal, the metal nip former including a contact face disposed in at least a part of a lateral end span of the nip former in a longitudinal direction of the nip former, the contact face to contact the thermal conductor, the metal nip former structured to be wider than the support in a direction orthogonal to the longitudinal direction and to contact a front face of the resin nip former, a side face of the support, and without contacting a back face of the support which faces away from the resin nip former.

17. An image forming apparatus comprising:

an image bearer to bear an image; and a fixing device to fix the image on a recording medium, the fixing device including:

a fixing rotator to rotate;

a heat source to heat the fixing rotator;

a pressure rotator to contact an outer circumferential surface of the fixing rotator;

a nip former disposed opposite the pressure rotator via the fixing rotator to form a nip between the fixing rotator and the pressure rotator; and a support to support the nip former against pressure from the pressure rotator, the support including a metal, the nip former including:

a resin nip former made of resin; and a metal nip former made of metal and interposed between the resin nip former and the fixing rotator, the metal nip former including a contact face disposed in at least a part of a lateral end span of the nip former in a longitudinal direction of the nip former, the contact face to contact the metal of the support, the metal nip former structured to be wider than the support in a direction orthogonal to the longitudinal direction and to contact a front face of the resin nip former, a side face of the support, and without contacting a back face of the support which faces away from the resin nip former.

* * * * *